US008103056B2

(12) United States Patent
Krishnaswamy et al.

(10) Patent No.: US 8,103,056 B2
(45) Date of Patent: Jan. 24, 2012

(54) METHOD FOR TARGET GEO-REFERENCING USING VIDEO ANALYTICS

(75) Inventors: Kailash Krishnaswamy, Little Canada, MN (US); Roland Miezianko, Plymouth, MN (US); Sara Susca, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 770 days.

(21) Appl. No.: 12/251,568

(22) Filed: Oct. 15, 2008

(65) Prior Publication Data

US 2010/0092033 A1 Apr. 15, 2010

(51) Int. Cl.
*G06K 9/00* (2006.01)
*G01C 21/00* (2006.01)

(52) U.S. Cl. ..... 382/103; 382/291; 701/213

(58) Field of Classification Search ..... 382/100, 382/103, 106, 107, 155, 162, 168, 170, 173, 382/181, 193, 194, 199, 203, 205, 206, 209, 382/216–221, 224, 232, 254, 274, 276, 286–291, 382/296, 305, 312, 321; 701/200, 207, 1, 701/213; 342/357.31
See application file for complete search history.

(56) References Cited

U.S. PATENT DOCUMENTS

| | | | | |
|---|---|---|---|---|
| 4,115,803 | A * | 9/1978 | Morton | 382/286 |
| 5,275,354 | A | 1/1994 | Minor et al. | |
| 5,878,356 | A * | 3/1999 | Garrot et al. | 701/1 |
| 5,881,969 | A | 3/1999 | Miller | |
| 6,157,875 | A | 12/2000 | Hedman et al. | |
| 6,388,611 | B1 * | 5/2002 | Dillman | 342/357.31 |
| 6,442,476 | B1 * | 8/2002 | Poropat | 701/207 |
| 6,920,391 | B2 * | 7/2005 | Daubert et al. | 701/200 |
| 7,246,008 | B2 * | 7/2007 | Daubert et al. | 701/200 |
| 2008/0080789 | A1 * | 4/2008 | Marks et al. | 382/296 |
| 2008/0144961 | A1 | 6/2008 | Litzenberger et al. | |

FOREIGN PATENT DOCUMENTS

GB 2297008 7/1996

OTHER PUBLICATIONS

European Patent Office, "European Search Report", Feb. 18, 2010, Published in: EP.

* cited by examiner

*Primary Examiner* — Seyed Azarian
(74) *Attorney, Agent, or Firm* — Fogg & Powers LLC

(57) ABSTRACT

A method to geo-reference a target between subsystems of a targeting system is provided. The method includes receiving a target image formed at a sender subsystem location, generating target descriptors for a first selected portion of the target image, sending target location information and the target descriptors from a sender subsystem of the targeting system to a receiver subsystem of the targeting system, pointing an optical axis of a camera of the receiver subsystem at the target based on the target location information received from the sending subsystem, forming a target image at a receiver subsystem location when the optical axis is pointed at the target, and identifying a second selected portion of the target image formed at the receiver subsystem location that is correlated to the first selected portion of the target image formed at the sender subsystem location.

19 Claims, 7 Drawing Sheets

METHOD FOR TARGET GEO-REFERENCING USING VIDEO ANALYTICS

BACKGROUND

Military applications often use scouts to locate a target. The scout sends information about the target location to a firing station, where the required firepower is located. Typically, the scout is remotely located from the firing station. Once a target is discovered and sighted by the scout, the target location is identified, and the target location is sent to the firing station. The firing station attempts to identify the target based on the input from the scout.

Once a precise location of the target is known by a scout, it is desirable to share the precise location with another part of the targeting system. In some cases it is difficult for the scout transmit enough information in order to precisely identify the target for the firing station. For example, a specific window in a building may be the target, but the specific window is not necessarily known by or identifiable to the firing station even if the scout accurately and precisely knows the target location.

In many cases, the firing station is unable to accurately identify the target based on the information received from the scout. In some cases, the confusion is due to the difference in the viewing angle of the target from the scout and the firing station. For example, if the view of the target as seen by the scout is clear but the view seen by the firing station has a reflection from the sun that obscures details about the target that are sent from the scout, then the target is not able to be accurately identified by the firing station.

SUMMARY

The present application relates to a method to geo-reference a target between subsystems of a targeting system. The method includes receiving a target image formed at a sender subsystem location, generating target descriptors for a first selected portion of the target image responsive to receiving the target image. The method further includes sending target location information and the target descriptors from a sender subsystem of the targeting system to a receiver subsystem of the targeting system. The method also includes pointing an optical axis of a camera of the receiver subsystem at the target based on the target location information received from the sending subsystem, forming a target image at a receiver subsystem location when the optical axis is pointed at the target, and identifying a second selected portion of the target image formed at the receiver subsystem location that is correlated to the first selected portion of the target image formed at the sender subsystem location. The identification of the second selected portion of the target image is based on the target descriptors received from the sending subsystem.

DRAWINGS

In accordance with common practice, the various described features are not drawn to scale but are drawn to emphasize features relevant to the present invention. Like reference characters denote like elements throughout figures and text.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

The targeting system to geo-reference a target location described herein is operable to accurately share the precise location of a target between subsystems of the targeting system. The terms "location" and "geo-location" are used interchangeably herein. As is known in the art, accuracy is the degree of correctness of a quantity, expression, etc., i.e., the accuracy of a measurement is a measure of how close the result of the measurement is to the true value. As is known in the art, precision is the degree to which the correctness of a quantity is expressed, i.e., the precision of a measurement is a measure of how well the result has been determined without reference to its agreement with the true value.

As described above, it is desirable to be able to accurately and precisely locate a target (such as a specific window in a large building) and to transmit information to a subsystem in the targeting system so that the subsystem can also accurately and precisely locate the target even when the bandwidth of the media in which the data is exchanged is not necessarily high bandwidth. Geo-referencing is used as described herein to establish raster or vector images so that at least one unique identifier at a target location is recognized within a selected portion of the target image by a first subsystem. The first subsystem sends the at least one unique identifier to a second subsystem. The second subsystem uses the at least one unique identifier to recognize the selected portion of the target image at the second subsystem. The first and second subsystems can be at separate locations.

Figure 1:
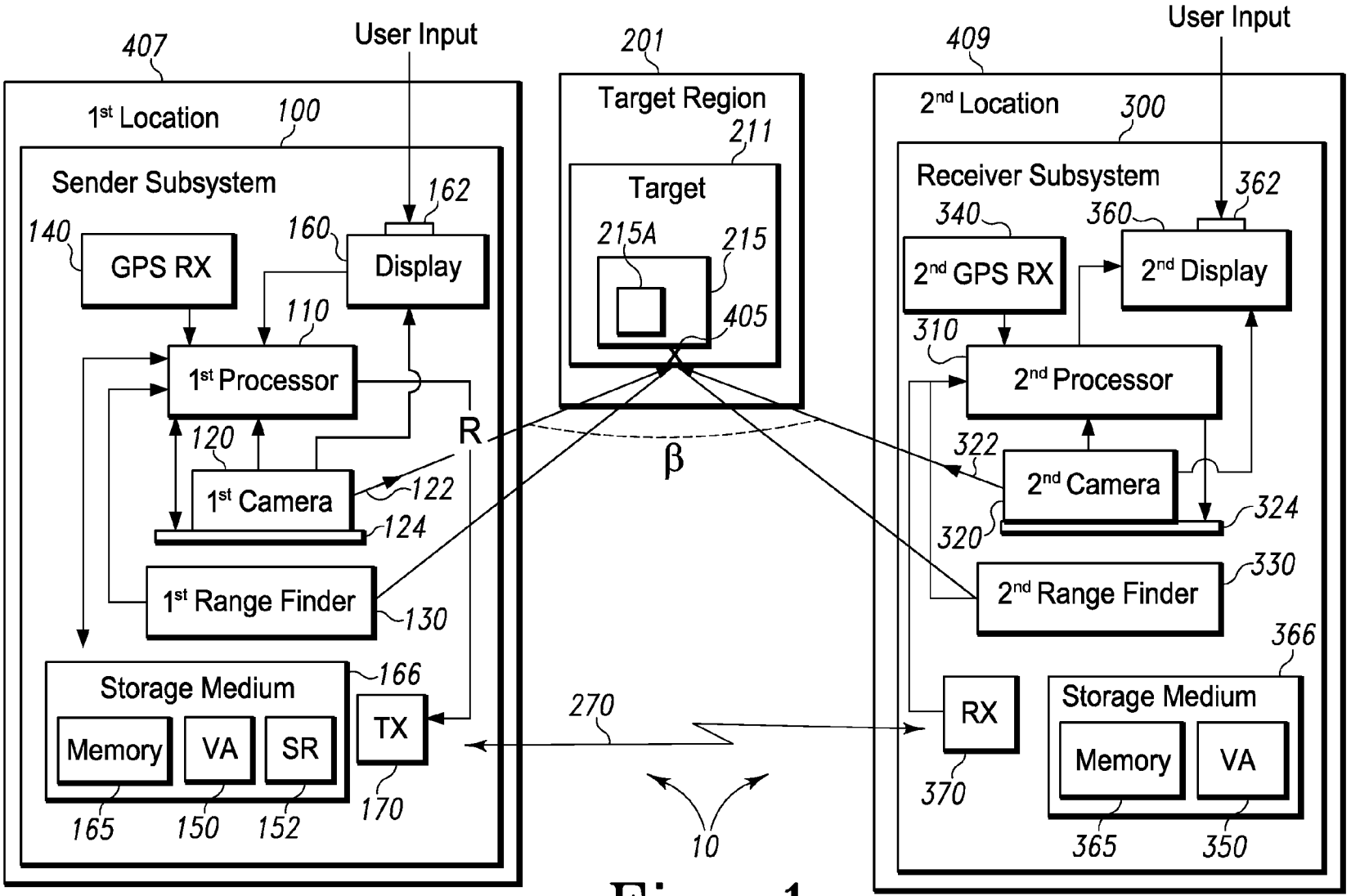
FIG. 1 is a block diagram of a targeting system to geo-reference a target location in accordance with an embodiment of the present invention.

FIG. 1 is a block diagram of a targeting system 10 to geo-reference a target location 405 in accordance with an embodiment of the present invention. The targeting system 10 includes a sender subsystem 100 positioned at a first location 407 and a receiver subsystem 300 positioned at a second location 409. The receiver subsystem 300 is communicatively coupled to the sender subsystem 100 by the communication link 270, which is shown as a wireless link, but which may be a wired link. In one implementation of this embodiment, the target location 405 is a geo-location and the information indicative of the target location 405 includes latitude, longitude, and altitude. For sake of illustration, the target location is shown as an X in the target 211.

The sender subsystem 100 includes a first camera 120, a first display 160, a first processor 110, a first range finder 130, a first global positioning system receiver (GPS RX) 140, a transmitter (TX) 170, and storage medium 166. The storage medium 166 includes a memory 165, a video analytics (VA) function 150, and a scene rendering (SR) function 152. The first camera 120 is positioned on a movable first camera platform 124 and has an optical axis 122. The first camera platform 124 can be adjusted to orient the optical axis 122 about three orthogonal axes.

The receiver subsystem 300 includes a second camera 320, a second display 360, a second processor 310, a second range finder 330, a second global positioning system receiver (GPS RX) 340, a receiver (RX) 370, and storage medium 366. The storage medium 366 includes a memory 365 and a video analytics (VA) function 350. The second camera 120 is positioned on a movable second camera platform 124 and has an optical axis 322. The second camera platform 324 can be adjusted to orient the optical axis 322 about three orthogonal axes, which can differ from the three orthogonal axes about which the first camera platform 124 can be adjusted.

An embodiment of the operation of the targeting system 10 to geo-reference a target location 405 is now described. The first processor 110 receives information indicative of the target image and generates target descriptors for a first selected portion of the target image. In one implementation of this embodiment, the target image is an image of the target region 201 in which the target 211 is located. As shown in FIG. 1, the target region 201 includes all of target 211. The first selected portion 215 of the target image (also referred to herein as the "selected portion 215") is shown in FIG. 1 as a subset of the target 211. The box 215A is representative of a subset of the first selected portion of the target. In one implementation of this embodiment, the first selected portion of the target image formed at a sender subsystem location 407 is reduced to a subset image of the first selected portion 215 of the image target. The subset image is the image of the subset 215A. In another implementation of this embodiment, the first selected portion 215 includes a portion of the target region 201 and a portion of the target 211.

For an exemplary case, if the target 211 is a vehicle parked in a parking lot, the image of the target region 201 that is focused on the focal plane of the first camera 120 can include other vehicles adjacent to the target 211 in the parking lot. In another exemplary case, the image of the target region 201 that is focused on the focal plane of the first camera 120 includes less than the complete target 211. For example, if the target 211 is a building, the target image (i.e., target region 201) may include only a central portion of one wall of the building and the selected portion 215 is a subset of the target region 201. Thus, it is to be understood that the relative sizes of the boxes representative of the target region 201, the target 211 and a selected portion 215 of the target 211, can vary from those shown in FIG. 1, and are not intended to limit the scope of the invention. The subset 215A of the first selected portion 215 always encompasses an area that is less than the area of the first selected portion 215.

The video analytics function 150 is executable by the first processor 110 to generate target descriptors within the first selected portion 215 of the target image. The scene rendering function 152 is executable by the first processor 110, wherein output from the scene rendering function 152 is used by the video analytics function 150 to generate the target descriptors. In one implementation of this embodiment, the scene rendering function 152 is not required to generate the target descriptors. In this manner, the first processor 110 generates target descriptors for the first selected portion 215 of the target image 211.

The first processor 110 also generates a target location 405. The first processor 110 estimates the geo-location of the target 211 by using a navigation solution and the measured range R to the target 211. The transmitter 170 sends the target descriptors and information indicative of the target location 405 to the receiver subsystem 300. This information is sent to the receiver subsystem 300 so that the receiver subsystem 300 can quickly point the optical axis 322 towards the region of interest (i.e., the selected portion 215 or the subset 215A of the selected portion 215) so that only partial image analysis is necessary. Specifically, the receiver 370 receives the target descriptors and the information indicative of target location 405. Then the second processor 310 directs the optical axis 322 of the second camera 320 toward the target location 405. The second processor 310 identifies the portion of the target 211 that is correlated to the first selected portion 215 of the target image based on the received target descriptors.

The first camera platform 124 is communicatively coupled to the first processor 110 to receive instructions from the first processor 110 so that the orientation of the first camera platform 124 is controlled by the first processor 110. The first camera platform 124 rotates about three orthogonal axes and/or moves along the three orthogonal axes until the first camera platform 124 is orientated as is appropriate based on the received instructions. When the first camera platform 124 is adjusted so that the optical axis 122 points at the target 211 at target location 405, the first camera 120 forms an image of the target 211 (referred to herein as "target image") in a focal plane of the first camera 120. As defined herein, the optical axis 122 points at the target 211 at target location 405 when an image of the target 211 falls anywhere on the focal plane of the first camera 120. The information indicative of target image is sent to the communicatively coupled first display 160, where the image of the target 211 (or an image of a portion of the target 211 including the selected portion 215) is displayed for a user of the sender subsystem 100.

In one implementation of this embodiment, the user of the sender subsystem 100 points the first camera 120 toward the target 211. In one such implementation, an approximate target location is known and the orientation of the first camera platform 124 is not required. In another such implementation, the orientation of the first camera platform 124 is determined (by azimuthal and/or attitude measuring equipment on the first camera platform 124) and this information indicative of the first camera platform 124 orientation is sent to the first processor 110 for use in the determination of the target location 405.

The first processor 110 is communicatively coupled to receive information indicative of the target image from the first camera 120. The first processor 110 is communicatively coupled to the first global positioning system receiver (GPS RX) 140 in order to receive the first location 407 (also referred to herein as "information indicative of the first location 407") from the first global positioning system receiver (GPS RX) 140. The first processor 110 is communicatively coupled to the first range finder 130 in order to receive information indicative of the distance R between the first location 407 and the target location 405. The first processor 110 uses the information received from the first global positioning system receiver (GPS RX) 140 and the first range finder 130 to generate a target location 405 (also referred to herein as "information indicative of the target location 405").

The selected portion 215 is selected by a user of the sender subsystem 110, who uses a graphical user interface 162 on (or connected to) the first display 160 to select a portion of the target image that is displayed on the first display 160. In one implementation of this embodiment, the graphical user interface 162 is a mouse-like device. In another implementation of this embodiment, the user uses the graphical user interface 162 to initially identify the target 211 and then to select the selected portion 215 of the target region 201. In yet another implementation of this embodiment, the user uses graphical user interface 162 to initially identify the target 211 and the first processor 110 analyses the target region 201 and selects the selected portion 215 of the target region 201 (including at least a portion of the image of the target 211) based on perceptual characteristics of the target region 201 (for example, entropy) which will help determine the boundary of different perceptual qualities. In yet another implementation of this embodiment, interfaces other than a graphical user interface are used by the user to select the selected portion 215 of the target region 201 (including at least a portion of the image of the target 211).

The transmitter 170 is communicatively coupled to receive information indicative of the target descriptors and the target location 405 from the first processor 110. The transmitter 170 sends the target descriptors and the target location 405 to the receiver subsystem 300 via communication link 270. Based on the desired response time of the targeting system 10, the amount of communication delay that can be tolerated is determined before transmission of the target descriptors and the target location 405 to the receiver subsystem 300. The video analytics function 150 addresses a low bandwidth requirement for the communication link 270 by transmitting data for only a small region (i.e., the selected portion 215 or the subset 215A of the selected portion 215) of the target 211 and also dynamically transmitting either the target descriptor or the gray scale image, whichever requires the least data.

The receiver 370 in the receiver subsystem 300 receives the target descriptors and the target location 405 from the transmitter 170. Responsive to receiving the information indicative of target location 405, the second processor 310 uses its estimated geo-location and directs the optical axis 322 of the second camera 320 toward the target location 405 by adjusting the second camera platform 324. As defined herein, the optical axis 322 points toward or at the target location 405 when an image of the target 211 falls anywhere on the focal plane of the second camera 320. The receiver subsystem 300 then collects range and vision data from the second range finder 330 and the second camera 320. The video analytics function 350 of the receiver subsystem 300 then takes over. A second selected portion 215 around the estimated position of the target 211 is selected. The target descriptors for the second selected region 215 is determined at the receiver subsystem 300 and compared to the target descriptors for the first selected region 215 received from the sender subsystem 100. If the gray scale image was sent instead of the target descriptor, due to bandwidth limitations, the video analytics function 350 of the receiver subsystem 300 determines the target descriptor for both the views (the received and generated) and compares them.

If a match is found, the receiver subsystem 300 considers the target to be identified. As defined herein, when the second selected region 215 is matched to the first selected region 215, the second selected region 215 is correlated to the first selected region 215. In this manner, the second processor 310 identifies a selected portion 215 (also referred to herein as "second selected portion 215") of the target that is correlated to the first selected portion 215 of the target image based on the received target descriptors. Thus, although the image of the first selected portion 215 viewed on the first display 160 may differ in appearance from the image of the second selected portion 215 viewed on the second display 360, the user of the receiver subsystem 300 selects a second selected portion 215 that is essentially the same as the first selected portion 215 selected by a user of the sender subsystem 100. This difference in appearance can be due to a difference in perspective and/or a difference in light conditions reflected from the selected portion 215 of the target 211 as seen from the first location 407 and the second location 409. In one implementation of this embodiment, if a match is found than an icon on the second display 360 changes color. In another implementation of this embodiment, if a match is found than an icon appears on the second display 360 over the second selected region 215 to identify the target.

The video analytics function 350 relies on the fact that the sender subsystem 300 is able to geo-locate the target 210 and take an image of it. Misalignment between the second laser ranger 330, the second camera 320, and the second global positioning system receiver 340 (and/or an inertial measurement unit) can potentially lead to erroneous target recognition. In one implementation of this embodiment, a Kalman filter is used to estimate the misalignment during run time.

The various components of the sender subsystem 100 are communicatively coupled to one another as needed using appropriate interfaces (for example, using buses, traces, cables, wires, ports, wireless transceivers and the like). The first camera platform 124 is mechanically controlled by appropriate interfaces (for examples, gears, gear boxes, chains, cams, electro-magnetic devices, hydraulic, gas-pressure devices and piezoelectric, chemical and/or thermal devices) that operate responsive to instructions received from the first processor 110. In one implementation of this embodiment, the first range finder 130 and the first camera 120 are both hardwired to the first processor 110. In another implementation of this embodiment, the first range finder 130 and the first camera 120 are communicatively coupled by a wireless link. Likewise, the various components of the receiver subsystem 300 are communicatively coupled to one another as needed using appropriate interfaces and the second camera platform 324 is mechanically controlled by appropriate interfaces.

Memory 165 comprises any suitable memory now known or later developed such as, for example, random access memory (RAM), read only memory (ROM), and/or registers within the first processor 110. In one implementation, the first processor 110 comprises a microprocessor or microcontroller. Moreover, although the first processor 110 and memory 165 are shown as separate elements in FIG. 1, in one implementation, the first processor 110 and memory 165 are implemented in a single device (for example, a single integrated-circuit device). In one implementation, the first processor 110 comprises processor support chips and/or system support chips such as application-specific integrated circuits (ASICs).

In one implementation of this embodiment, the video analytics function 150, and the scene rendering function 152 are stored in the first processor 110. The first processor 110 executes the video analytics function 150, the scene rendering function 152, and other software and/or firmware that causes the first processor 110 to perform at least some of the processing described herein as being performed by the first processor 110. At least a portion of the video analytics function 150, a scene rendering function 152, and/or firmware executed by the first processor 110 and any related data structures are stored in storage medium 166 during execution.

Memory 365 comprises any suitable memory now known or later developed such as, for example, random access memory (RAM), read only memory (ROM), and/or registers within the second processor 310. In another implementation of this embodiment, the video analytics function 350 is stored in the second processor 310. The second processor 310 executes the video analytics function 350 and other software and/or firmware that cause the second processor 310 to perform at least some of the processing described here as being performed by the second processor 310. At least a portion of the video analytics function 350 and/or firmware executed by the second processor 310 and any related data structures are stored in storage medium 366 during execution.

Figure 2C:
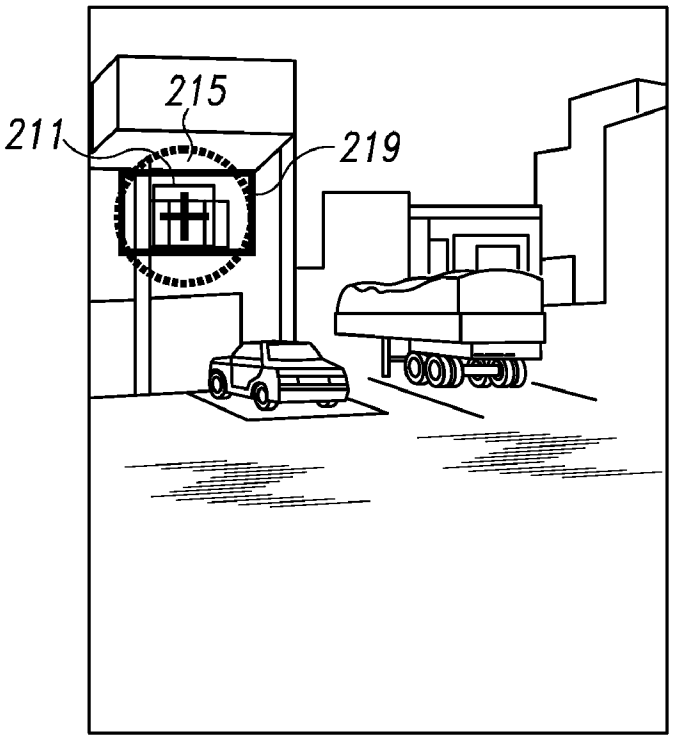
FIGS. 2A-2C show an exemplary target image formed at a first location and a second location and a representation of exemplary segments within a selected portion of the target image formed at the first location.
Figure 2B:
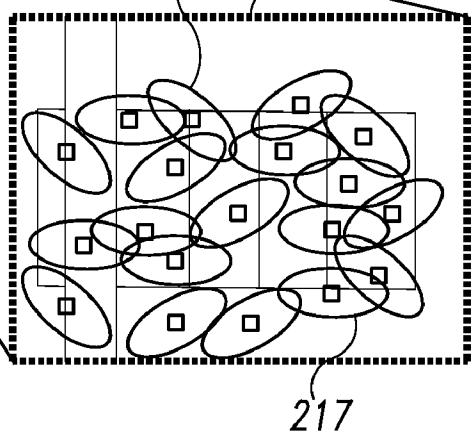
Figure 2A:
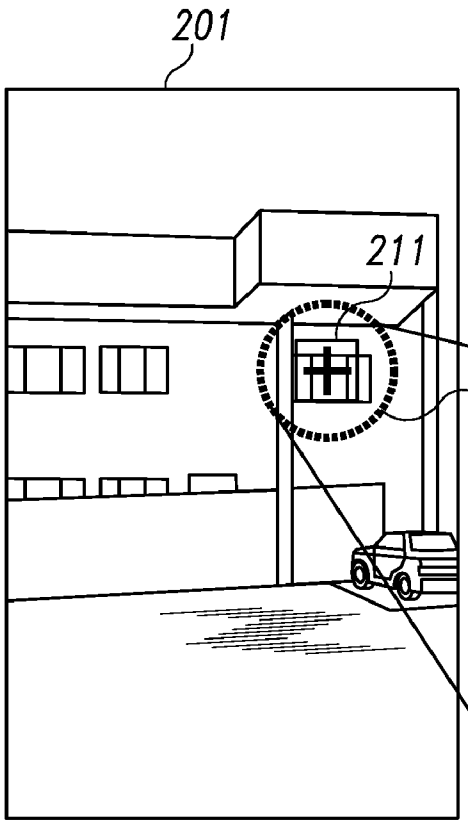

The implementation of the system 10 is now described with reference to FIGS. 2A-2C and FIGS. 3A-3D. FIGS. 2A-2C show an exemplary target image formed at a first location (FIG. 2A) and a second location (FIG. 2C) and a representation of exemplary segments represented generally at 217 (FIG. 2B) within a selected portion 215 of the target image formed at the first location. As shown in FIG. 2A, the target region 201 is the complete image, while the dashed circle that is centered on a plus sign (+) is the first selected portion 215, which includes at least a portion of the target 211. In this exemplary embodiment, the image of the target 211 is a relatively small portion of the target region 201 while the selected portion 215 is larger than the target 211.

The video analytics function 150 performs an on-demand scene encoding of the first selected portion 215 of the target image as viewed on the focal plane of the first camera 120 at the sender subsystem 100. The video analytics function 150 executed by the first processor 110 has the following key characteristics and capabilities:

1) determining target descriptors that are robustly identifiable across different views of the same scene;

2) receiving input from the scene rendering function 152 to generated the target descriptors when the prospective views of the target 211, as seen by the sender subsystem 100 and the receiver subsystem 300, differ dramatically;

3) limiting the bandwidth required for communication between the transmitter 170 and the receiver 370 (according to the bandwidth of the communication link 270) by minimizing the information transmitted and limiting the time sensitivity of information; and 4) using the range information from the first range finder 130 together with the image data from the first camera 120 to allow a user of the receiver subsystem 300 to quickly locate and view the target 211 through the second camera 320.

The video analytics algorithm 150 of the sender subsystem 100 selects the first selected portion 215 of the target image. Visual and range information for this first selected portion 215 is captured and recorded. Then, at least one target descriptor for the first selected portion 215 is determined. The target descriptor robustly describes the target region 201 around the target 211 so that the target 211 can be correctly detected in the view of the second camera 320 in the receiver subsystem 300. In order to achieve robustness, the target descriptor includes the information about multiple features extracted in the first selected portion 215 around the target 211 and its estimated geo-location.

A diagram of the video analytics operation is shown in FIG. 2B. In FIG. 2B, the segments 217 that are each centered on dots are representative areas for which target descriptors are generated. The segments 217, shown in this exemplary case as ellipsoids, encircle a plurality of pixels that image a particular feature. In one implementation of this embodiment, subsets of the segments 217 are generated for a particular type of physical characteristic, such as high contrast, high reflectivity from a point, one or more selected emissivity values, entropy, etc. The target descriptors are only generated for the area within the selected portion 215 of the image. The segments 217 are illustrative of any shape that can be used to enclose the feature for which a target descriptor is generated.

In one implementation of this embodiment, the encoded scene information is transmitted to the receiver 370 as a commanded for ICON placement. In this case, an icon (such as the box labeled as 219 in FIG. 2C) is inserted over the image of the target 211 that was generated when the optical axis 322 of the second camera 320 was pointed at the target location 405 and the second camera 320 was focused on the target 211.

Once the first processor 110 determines (or retrieves from memory 165) the geo-locations of the first location 407, the second location 409, and the target location 405, the first processor 110 determines the relative positions of the sender subsystem 100 at a first location 407, the receiver subsystem 300 at a second location 409, and the target location 405. The processor executes software in the storage medium 166 to determine differences between the two views. If the two views differ more than a predefined threshold they are declared as substantially different.

Although texture descriptors (such as those computed by scale invariant feature transform (SIFT)) can be matched across two somewhat different views of the same scene, they can fail in cases when the two views are dramatically different. Thus, when two views are substantially different, scene rendering is performed on the data. Scene rendering reduces false matches. In such a situation, the video analytics algorithm 150 first renders the scene from the receiver's view and then determines the target descriptor. In one implementation of scene rendering, a combined shape and texture descriptor is generated for each feature. In another implementation of this embodiment, the edges are used to generate target descriptors. In yet another implementation of this embodiment, a skeleton is used to generate target descriptors. A combined descriptor is more robust to changes in illumination and provides enhanced performance under a wide range of imaging conditions. In another implementation of this embodiment, scene rendering is done by augmenting the sensor inputs with 3D scene information from a steerable laser ranger (such as a Velodyne Lidar).

The video analytics technology shown in FIGS. 2A-2C is dependent on line-of-sight (LOS) visibility of the target 211 by both the sender subsystem 100 and the receiver subsystem 300. In the absence of line-of-sight visibility or for challenging target regions where shape and texture descriptors may not uniquely identify a target, a target orientation determination system (TODS) assists the video analytics function 150 and the video analytics function 350 in the process of matching the selected portion 215. The TODS computes the geo-referenced orientation of the target region 201 in order to improve the probability of correct target identification by the sender subsystem 300. The target orientation determination is one of the methods of doing scene rendering and is implemented by the execution of video analytics function 150, the scene rendering function 152, and the video analytics function 350. TODS estimates the orientation or planes in the target region 201 and appends it to the target region descriptors before transmission to the receiver subsystem 300. In this way, TODS improves the probability of correct target identification in operations where the view at the receiver subsystem 300 is occluded by structures that can be well defined in geo-referenced geometry.

Figures 3A, 3B, 3C, 3D:
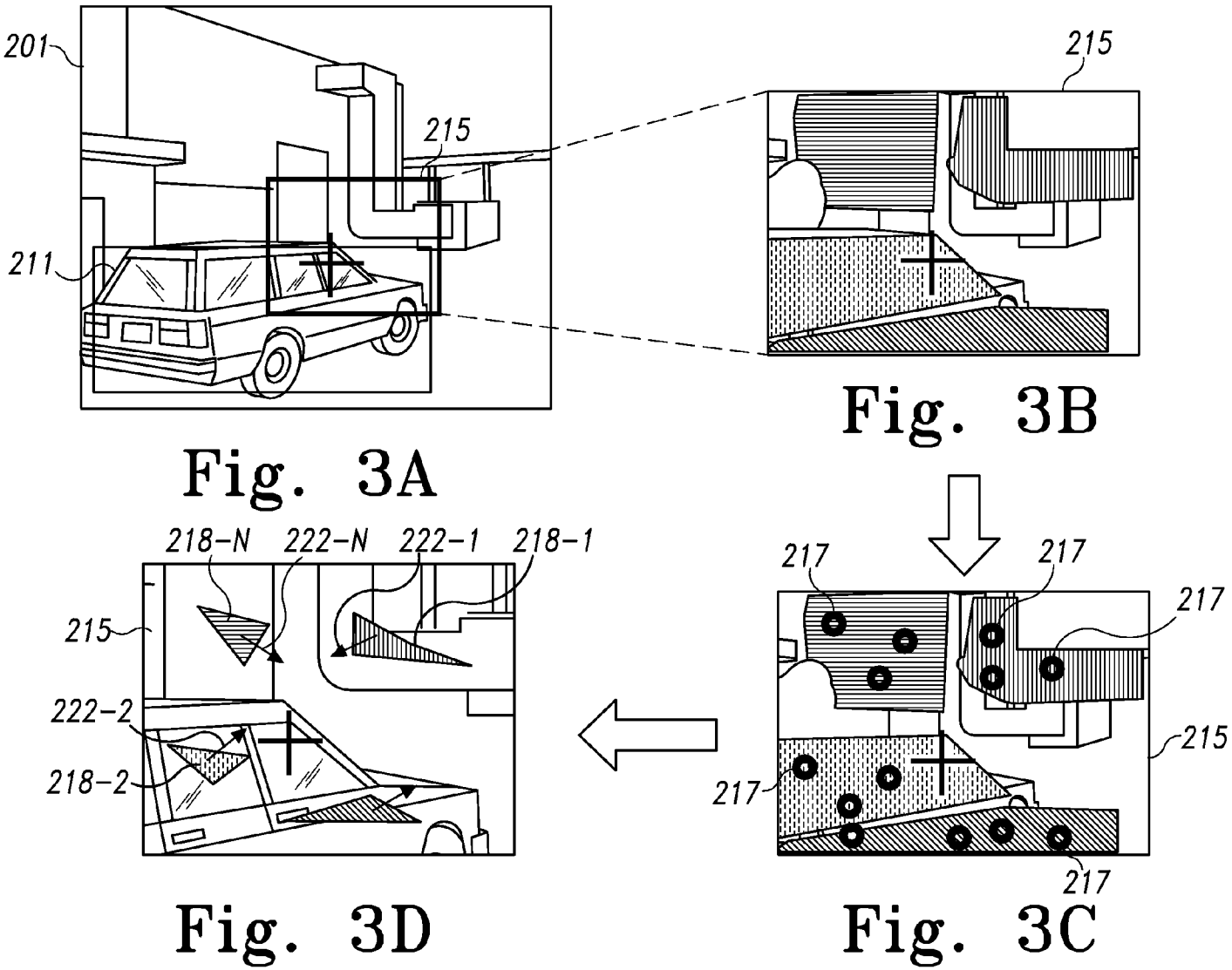
FIGS. 3A-3D are illustrative of scene rendering using a target orientation determination for an exemplary target in accordance with an embodiment of the present invention.

FIGS. 3A-3D are illustrative of scene rendering using a target orientation determination for an exemplary target in accordance with an embodiment of the present invention. The target orientation determination consists of: image segmentation of the target region using graph-based methods; geo-referenced ranging of each segment of the target region; and plane and orientation determination of each segment in the target region. FIG. 3A shows an exemplary target 211 (a car) in a target region 201 (a city street). FIG. 3B shows a selected portion 215 (the front passenger window and a portion of the street and background buildings) of the target region 201 of FIG. 3A. FIG. 3C shows segments 217 (shown in this embodiment as circles) within the selected portion 215. Geo-referenced ranging is done for each segment 217 of the selected regions 215 in the target region 201. In FIG. 3D, shows the planes represented generally at 218(1-N) and the plane orientation represented generally at 222(1-N) (shown as arrows) determined for groups of the segments 217 in FIG. 3C.

For example, plane 218-1 is generated from the segments 217 within the image of a duct in the selected region 215, and plane 218-2 is generated from the segments 217 within the image of a passenger window in the selected region 215. The planes 218(1-N) and the associated plane orientations 222(1-N) are generated during an implementation of the scene rendering function 152 (FIG. 1). The perceptual characteristics of the target region 201 (for example, entropy), which will help determine the boundary of different perceptual qualities, are determined by the scene rendering function 152.

A challenging aspect in image segmentation is the tradeoff between computational time and ability to capture perceptually relevant global characteristic of a scene. Graph-based methods are very versatile and can be tuned to be faster while still preserving the ability to segment the scene in perceptually meaningful way. These methods treat each pixel as a node. An edge between two nodes is established if the chosen dissimilarity index between two pixels is lower than a threshold thus defining potentially disjoint connected regions. The plane and orientation determination of each segment in the target region is appended to the target region descriptor sent from the sender subsystem 100. The video analytics function 350 of the receiver subsystem 300 is modified to perform matching based on the target orientation information in the descriptor in addition to shape and texture descriptors.

In one implementation of this embodiment, the first processor 110 recognizes the target 211 is moving and using the information received from the first camera 120 and the first range finger 130 determines the velocity with which the target 211 is moving. In this case, the first processor 110 sends information indicative of the velocity of the target 210 to the receiver subsystem 300 via the transmitter 170 along with the information indicative of target location 405 and the target descriptors.

Figure 4A:
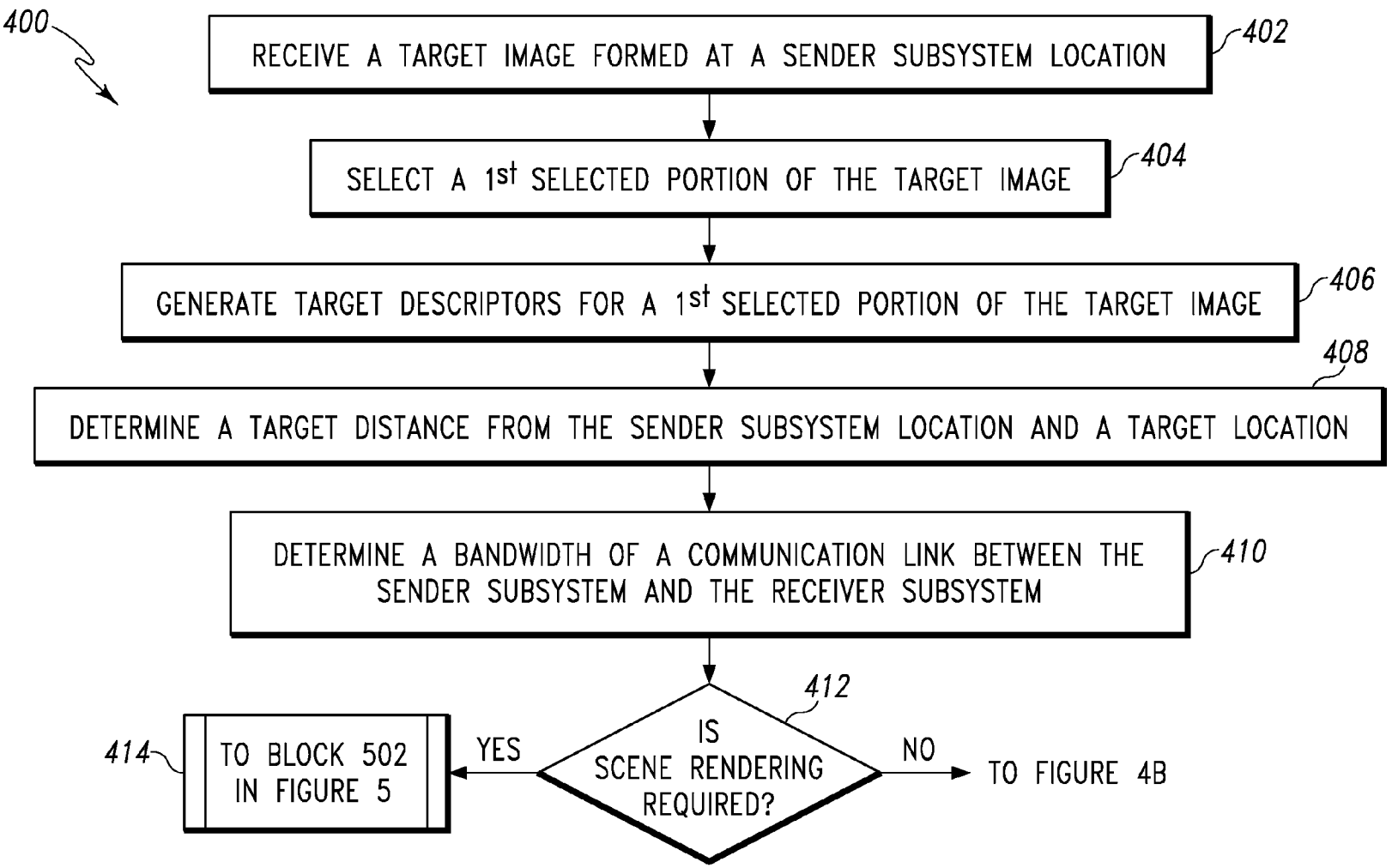
FIG. 4 is a flow diagram of one embodiment of a method to geo-reference a target between subsystems of a targeting system in accordance with the present invention.
Figure 4B:
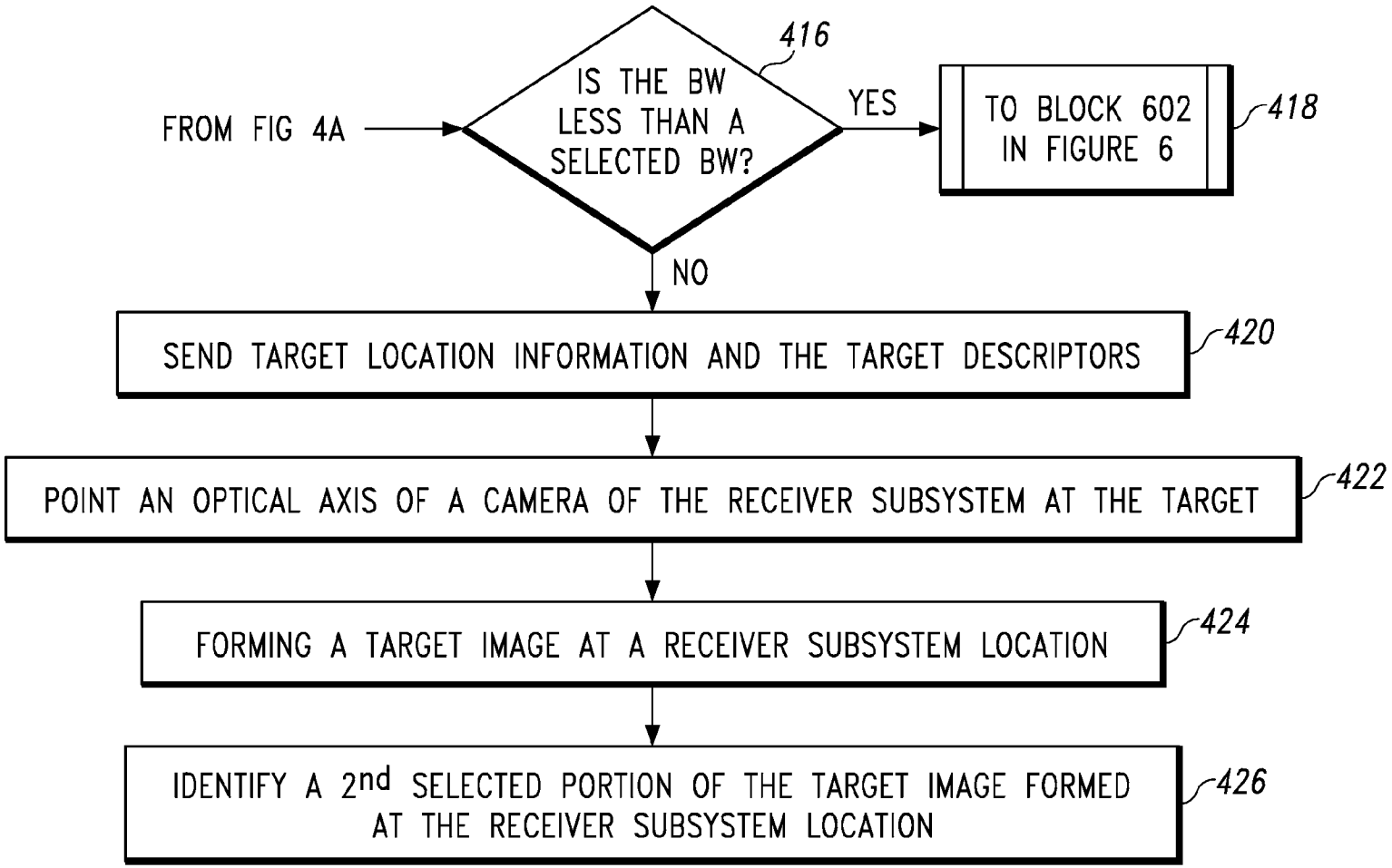

FIG. 4 is a flow diagram of one embodiment of a method 400 to geo-reference a target between subsystems of a targeting system in accordance with the present invention. In one implementation of this embodiment, the targeting system is targeting system 10 as described above with reference to FIGS. 1, 2A-2D, and 3A-3D. The method 400 is described with reference to the targeting system 10 shown in FIG. 1 although it is to be understood that method 400 can be implemented using other embodiments of the virtual network as is understandable by one skilled in the art who reads this document.

At block 402, the first processor 100 receives a target image formed at a sender subsystem location 407. The target image is formed at the focal plane of the first camera 120 when the optical axis 122 of the first camera 120 is pointed at the target 211. At block 404, the first selected portion 215 of the target image is selected from the target image formed at the sender subsystem location 407.

At block 406, target descriptors are generated for the first selected portion 215 of the target image responsive to receiving the target image. The first processor 110 executes the video analytics function 150 or the scene rendering function 150 and the video analytics function 150 to generate the target descriptors.

At block 408, a target distance R between the sender subsystem location 407 and a target location 201 is determined. In one implementation of this embodiment, determining the target location 405 includes receiving information indicative of the sender subsystem location (i.e., the first location 407) at the first processor 110 from first global positioning system receiver 140, determining a target distance R (FIG. 1) between the sender subsystem 100 and the target 211 based on information received at the first processor 110 from the first range finder 130, determining an angle of elevation between the sender subsystem 100 and the target 211 based on an orientation of the first camera platform 124 (i.e., an orientation of the optical axis 122 of the first camera 120), and determining the target location 405 based on the sender subsystem location 407 and the determined distance R, and angle of elevation between the sender subsystem 100 and the target 211. In this manner, the target descriptors are robustly identifiable from different views of the target at the target location 405.

At block 410, a bandwidth of a communication link 270 between the sender subsystem 100 and the receiver subsystem 200 is determined. In one implementation of this embodiment, the first processor 110 determines the bandwidth of a communication link 270.

Figure 5:
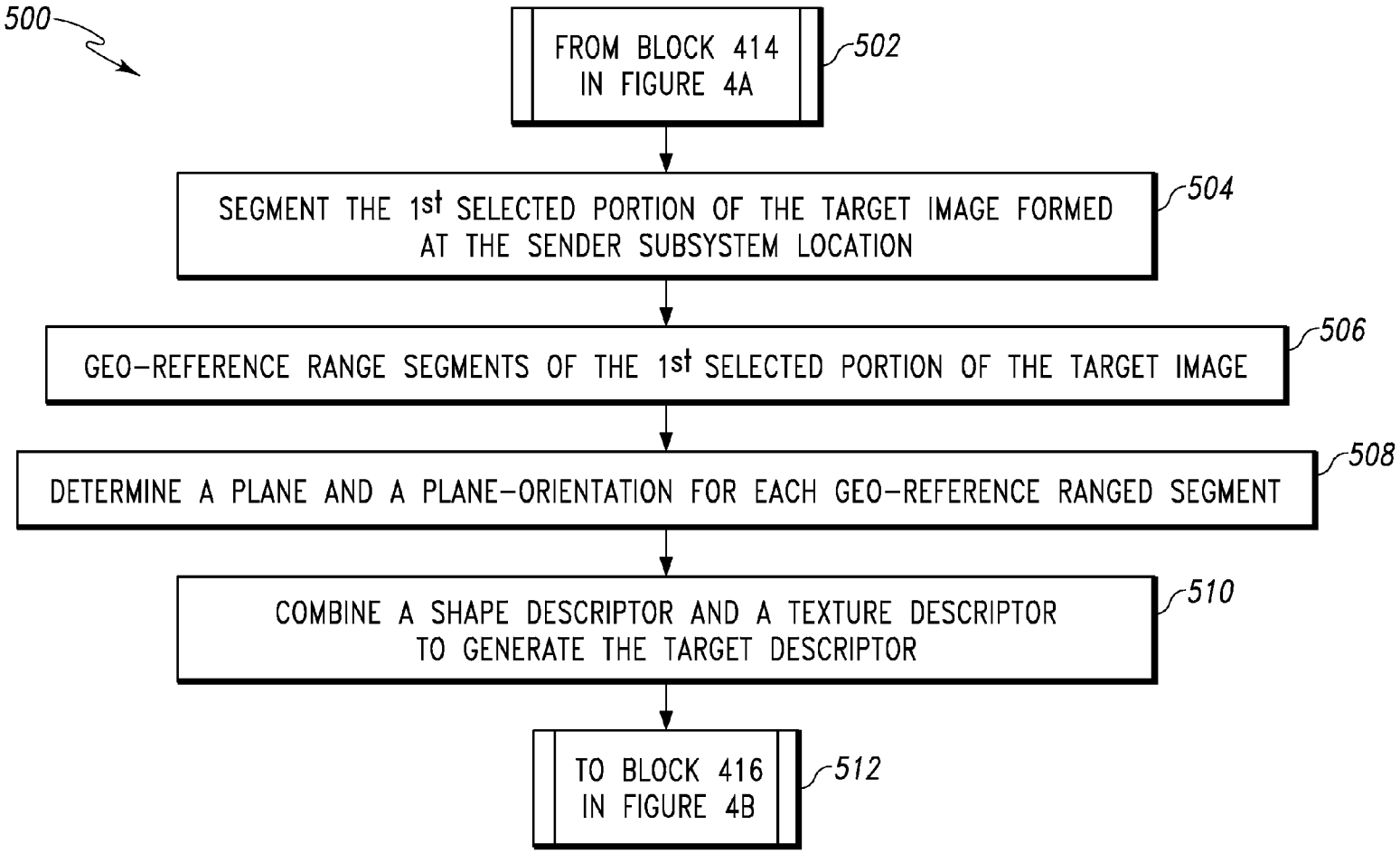
FIG. 5 is a flow diagram of a method to implement a scene rendering function in accordance with an embodiment of the present invention.

At block 412, it is determined if scene rendering is required. In one implementation of this embodiment, the first processor 110 determines if scene rendering is required based on the relative positions of the sender subsystem 100 at a first location 407, the receiver subsystem 300 at the second location 409, and the target 211 at the target location 409. If scene rendering in required, the flow of method 400 proceeds to block 414. At block 414, the flow proceeds to block 502 in FIG. 5. FIG. 5 is a flow diagram of a method 500 to implement a scene rendering function in accordance with an embodiment of the present invention. The flow of method 500 is described below.

If scene rendering in not required, the flow of method 400 proceeds to block 416. At block 416, it is determined if the bandwidth of communication link 270 is less than a selected bandwidth. In one implementation of this embodiment, the selected bandwidth is 1 MBps. In another implementation of this embodiment, the selected bandwidth is 100 MBps. If the bandwidth is less than the selected bandwidth, the flow proceeds to block 418.

Figure 6:
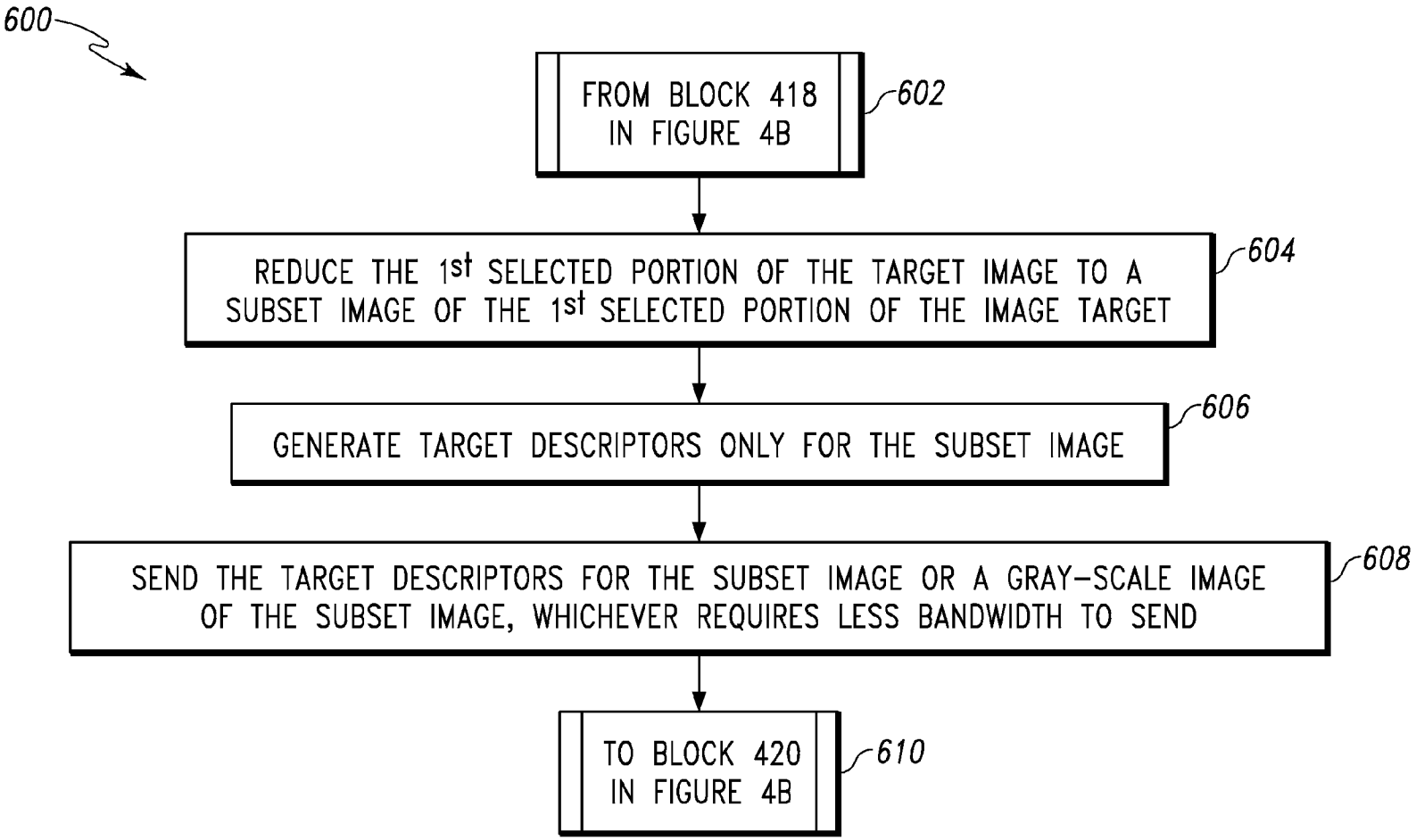
FIG. 6 is a flow diagram of a method to send target location information and target descriptors when bandwidth of a communication link is limited in accordance with an embodiment of the present invention.

At block 418, the flow of method 400 proceeds to block 602 in FIG. 6. FIG. 6 is a flow diagram of a method to send target location information and target descriptors when bandwidth of the communication link 280 is limited in accordance with an embodiment of the present invention. The flow of method 600 is described below.

If the bandwidth of the communication link 270 is greater than the selected bandwidth, the flow of method 400 proceeds to block 420. At block 420, target location information and the target descriptors are sent from a sender subsystem 100 of the targeting system 10 to a receiver subsystem 300 of the targeting system 10. At block 422, an optical axis 320 of a camera 320 (i.e., second camera 320) of the receiver subsystem 300 is pointed at the target 211 based on the target location information received from the sending subsystem 100. At block 424, a target image is formed at the receiver subsystem location 409 when the optical axis 322 is pointed at the target 211. At block 426, a second selected portion 215 of the target image formed at the receiver subsystem location 409 is identified. The second selected portion 215 of the target image is correlated to the first selected portion 215 of the target image formed at the sender subsystem location 407. The identification is based on the target descriptors received from the sending subsystem 100.

The method to determine target descriptors that are robustly identifiable across different views of the same scene is now described with reference to the flow of method 500 shown in FIG. 5. Block 502 indicates the flow proceeds from block 414 in FIG. 4. At block 504, the first selected portion 215 of the target image formed at the sender subsystem location is segmented. At block 506, the segments 217 of the first selected portion 215 of the target image formed at the sender subsystem location are geo-reference ranged. At block 508, a plane and a plane-orientation for each geo-reference ranged segment 217 are determined. At block 510, a shape descriptor is combined with a texture descriptor to generate the target descriptor for at least one feature of the first selected portion 215 of the target image. Block 510 is optional. At block 512, the flow proceeds to block 416 of method 400 of FIG. 4.

The method to send target location information and target descriptors when bandwidth of a communication link 270 is limited is now described with reference to the flow of method 600 shown in FIG. 6. Block 602 indicates the flow proceeds from block 418 in FIG. 4. At block 604, the first selected portion 215 of the target image formed at a sender subsystem location 407 is reduced to a subset image of the first selected portion of the image target. For example, the subset image of the first selected portion of the image target can be the image of the subset 215A of the first selected portion 215 of the target 211.

At block 606, target descriptors are generated only for the subset image of the first selected portion 215 of the target image. At block 608, the target descriptors for the subset image or a gray-scale image of the subset image are sent from the sender subsystem 100 to the receiver subsystem 300 via communication link 270. The transmitter 170 sends the target descriptors for the subset image when the target descriptors for the subset image require less bandwidth to send than the gray-scale image of the subset image would require. Likewise, the transmitter 170 sends the gray-scale image of the subset image when sending the gray-scale image of the subset image requires less bandwidth than sending the target descriptors for the subset image would require. The first processor 110 executes software to make that determination. At block 610, the flow proceeds to block 420 of method 400 of FIG. 4.

In one implementation of this embodiment, at least a portion of the sender subsystem 100 is worn by the user of the sender subsystem 100.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

We claim:

1. A method to geo-reference a target between subsystems of a targeting system, the method comprising:

receiving a target image formed at a sender subsystem location;

generating target descriptors for a first selected portion of the target image responsive to receiving the target image;

sending target location information and the target descriptors from a sender subsystem of the targeting system to a receiver subsystem of the targeting system;

pointing an optical axis of a camera of the receiver subsystem at the target based on the target location information received from the sending subsystem;

forming a target image at a receiver subsystem location when the optical axis is pointed at the target; and identifying a second selected portion of the target image formed at the receiver subsystem location that is correlated to the first selected portion of the target image formed at the sender subsystem location, the identification being based on the target descriptors received from the sending subsystem.

2. The method of claim 1, further comprising:

determining a target distance between the sender subsystem location and a target location; and implementing a scene rendering function at the sender subsystem responsive to receiving the target image formed at the sender subsystem location, the implementation being based on relative positions of the sender subsystem at a first location, the receiver subsystem at a second location, and the target at the target location, wherein the generating target descriptors is based on output from the scene rendering function.

3. The method of claim 2, wherein implementing a scene rendering function comprises:

segmenting the first selected portion of the target image formed at the sender subsystem location;

geo-reference ranging segments of the first selected portion of the target image formed at the sender subsystem location; and determining a plane and a plane-orientation for each geo-reference ranged segment.

4. The method of claim 3, wherein implementing a scene rendering function comprises:

combining a shape descriptor and a texture descriptor to generate the target descriptor for at least one feature of the first selected portion of the target image.

5. The method of claim 1, further comprising:

determining a bandwidth of a communication link between the sender subsystem and the receiver subsystem; and when the determined bandwidth is less than a selected bandwidth, reducing the first selected portion of the target image formed at a sender subsystem location to a subset image of the first selected portion of the image target;

generating target descriptors only for the subset image of the first selected portion of the target image; and sending one of the target descriptors for the subset image or a gray-scale image of the subset image, whichever requires less bandwidth to send.

6. The method of claim 1, further comprising determining a target location.

7. The method of claim 6, wherein determining the target location comprises:

receiving information indicative of the sender subsystem location;

determining a target distance between the sender subsystem and the target;

determining an angle of elevation between the sender subsystem and the target; and determining the target location based on the sender subsystem location and the determined distance and angle.

8. The method of claim 1, further comprising:

recognizing the target is moving at a velocity;

sending information indicative of the velocity of the target from the sender subsystem to the receiver subsystem.

9. The method of claim 1, further comprising:

selecting the first selected portion of the target image from the target image formed at the sender subsystem location.

10. The method of claim 9, further comprising:

indicating the second selected portion of the target image formed at the receiver subsystem location that is correlated to the first selected portion of the target image formed at the sender subsystem location.

11. A targeting system to geo-reference a target location, the system comprising:

a sender subsystem at a first location; and a receiver subsystem at a second location, the receiver subsystem communicatively coupled to the sender subsystem, wherein the sender subsystem includes, a first camera to form a target image, a first processor operable to receive information indicative of the target image and further operable to generate target descriptors for a first selected portion of the target image and to generate a target location, and a transmitter to send the target descriptors and the target location to the receiver subsystem, and wherein the receiver subsystem includes, a receiver to receive the target descriptors and the target location;

a second processor operable to direct an optical axis of a second camera toward the target location and further operable to identify the portion of the target that is correlated to the first selected portion of the target image based on the received target descriptors.

12. The targeting system of claim 11, further comprising:

a first camera platform communicatively coupled to the first processor, wherein an orientation of the first camera platform is controlled by the first processor.

13. The targeting system of claim 11, further comprising:

a storage medium to hold a video analytics function executable by the first processor to generate target descriptors within the first selected portion of the target image.

14. The targeting system of claim 13, wherein the storage medium additionally holds a scene rendering function executable by the first processor, wherein output from the scene rendering function is used by the video analytics function to generate the target descriptors.

15. The targeting system of claim 11, further comprising:

a first global positioning system receiver in the sender subsystem, the first global positioning system receiver communicatively coupled to send a first location to the first processor; and a second global positioning system receiver in the receiver subsystem, the second global positioning system receiver communicatively coupled to send a second location to the second processor.

16. The targeting system of claim 11, further comprising:

a first range finder in the sender subsystem, the first range finder communicatively coupled to send a target range to the first processor; and a second range finder in the receiver subsystem, the second range finder communicatively coupled to send a target range to the second processor.

17. The targeting system of claim 11, further comprising:

a first display in the sender subsystem, the first display operable to display the target image of the target viewed at the first location, the first display being communicatively coupled to send information indicative of the first selected portion of the target image to the first processor; and a second display in the receiver subsystem, the second display operable to display the target image of the target viewed at the second location in which the second selected portion of the target image is indicated by an icon.

18. A targeting system to accurately share a precise location of a target, comprising:

means for selecting a portion of a target image formed at a first location of the targeting system;

means for generating target descriptors for the selected portion;

means for sending target location information and the target descriptors from a sender subsystem of the targeting system to a receiver subsystem of the targeting system;

means for forming a target image at a second location of the targeting system;

means for identifying a selected portion of the target image formed at second location that is correlated to the selected portion of the target image formed at the sender subsystem location;

means for segmenting the selected portion into segments; and means for determining a plane and a plane orientation for each segment.

19. The targeting system of claim 18, further comprising:

means for determining bandwidth; and means for reducing the information sent by the means for sending based on output from the means for determining bandwidth.

* * * * *